United States Patent [19]

Morimoto et al.

[11] Patent Number: 4,701,389

[45] Date of Patent: Oct. 20, 1987

[54] PHOTOCONDUCTIVE TONER

[75] Inventors: Teruyo Morimoto, Kobe; Yumiko Sano, Ibaragi; Eiji Nimura, Tondabayashi; Yuji Tomii, Sakai; Tatsuo Maeda, Nishinomiya, all of Japan

[73] Assignee: Mita Industrial Co., Ltd., Osaka, Japan

[21] Appl. No.: 883,656

[22] Filed: Jul. 9, 1986

[30] Foreign Application Priority Data

Jul. 11, 1985 [JP] Japan ..... 60-153778

[51] Int. Cl.[4] ..... G03G 9/08

[52] U.S. Cl. ..... 430/110; 430/901

[58] Field of Search ..... 430/901, 110

[56] References Cited

U.S. PATENT DOCUMENTS 3,526,500 9/1970 Opdycke et al. ..... 430/901 X 3,764,312 10/1973 Honjo et al. ..... 430/901 X

*Primary Examiner*—J. David Welsh

*Attorney, Agent, or Firm*—Sherman and Shalloway

[57] ABSTRACT

Disclosed is a photoconductive toner comprising as a main component a photoconductive substance dissolved or dispersed in a binder resin medium, wherein when the photoconductive substance is a p-type semiconductor, it is combined with a binder resin having a positive tribochargeability and when the photoconductive substance is an n-type semiconductor, it is combined with a binder resin having a negative tribochargeability.

2 Claims, 6 Drawing Figures

PHOTOCONDUCTIVE TONER

BACKGROUND OF THE INVENTION (1) Field of the Invention

The present invention relates to a photoconductive toner. More particularly, the present invention relates to a photoconductive toner excellent in the photosensitivity.

(2) Description of the Prior Art

In the process where a reproduction image is formed without using a photosensitive drum or the like, use of a photoconductive toner has recently attracted attention. This photoconductive toner is prepared by dispersing or dissolving a photoconductive pigment and/or a charge transport substance in a binder resin and granulating the dispersion or solution by pulverization or spraying, and the toner per se has a photoconductivity.

As an example of the process for forming an image by using this photoconductive toner, there can be mentioned a process in which the steps of (i) uniformly applying the photoconductive toner on an electroconductive substrate to form a toner layer, (ii) uniformly charging the toner layer by corona discharge, (iii) subjecting the charged toner layer to imagewise light exposure, (iv) removing the toner in the exposed area from the substrate, (v) piling a copying sheet or the like on the toner layer and performing corona discharge from the back side of the transfer sheet to transfer the toner image and (vi) fixing the transferred toner image are sequentially carried out.

In this process, however, since the photosensitivity of the photoconductive toner is generally low, the difference of the charge between the exposed area and the non-exposed area is small in the latent image formed by the light exposure, and therefore, the contrast in the copied image is low.

As means for obviating this disadvantage, there has been proposed a method in which after formation of the toner image,corona charging is effected with the same polarity as that of the charge possessed by the toner, whereby the surface potential is increased to improve the photosensitivity. However, the above-mentioned problem cannot be completely solved.

SUMMARY OF THE INVENTION

It is therefore a primary object of the present invention to provide a photoconductive toner excellent in the photosensitivity, which provides a copied image having a good contrast.

In accordance with the present invention, there is provided a photoconductive toner comprising as a main component a photoconductive substance dissolved or dispersed in a binder resin medium, wherein when the photoconductive substance is a p-type semiconductor, it is combined with a binder resin having a positive tribochargeability and when the photoconductive substance is an n-type semiconductor, it is combined with a binder resin having a negative tribochargeability.

DETAILED DESCRIPTION OF THE PREFERRED EMBODIMENTS

The photoconductive toner of the present invention is in agreement with conventional toners in the point that a binder resin medium and a photoconductive material are contained as main components. However, the toner of the present invention is structurally characterized in a specific combination of the tribochargeability characteristic (especially the charge polarity) of the binder resin medium and the semiconductor characteristic of the photoconductive material. Namely, the present invention includes the following two embodiments.

(A) A binder resin having a positive tribochargeability is used for a photoconductive substance having a character of a p-type semiconductor.

(B) A binder resin having a negative tribochargeability is used for a semiconductive substance having a character of an n-type semiconductor.

By using this combination, the photosensitivity can be improved over that of the known photoconductive toner having the same basic structure, in which the above-mentioned combination is not considered at all.

It is believed that in the present invention, the above-mentioned excellent effect can be attained according to the following principle.

Figure 1:
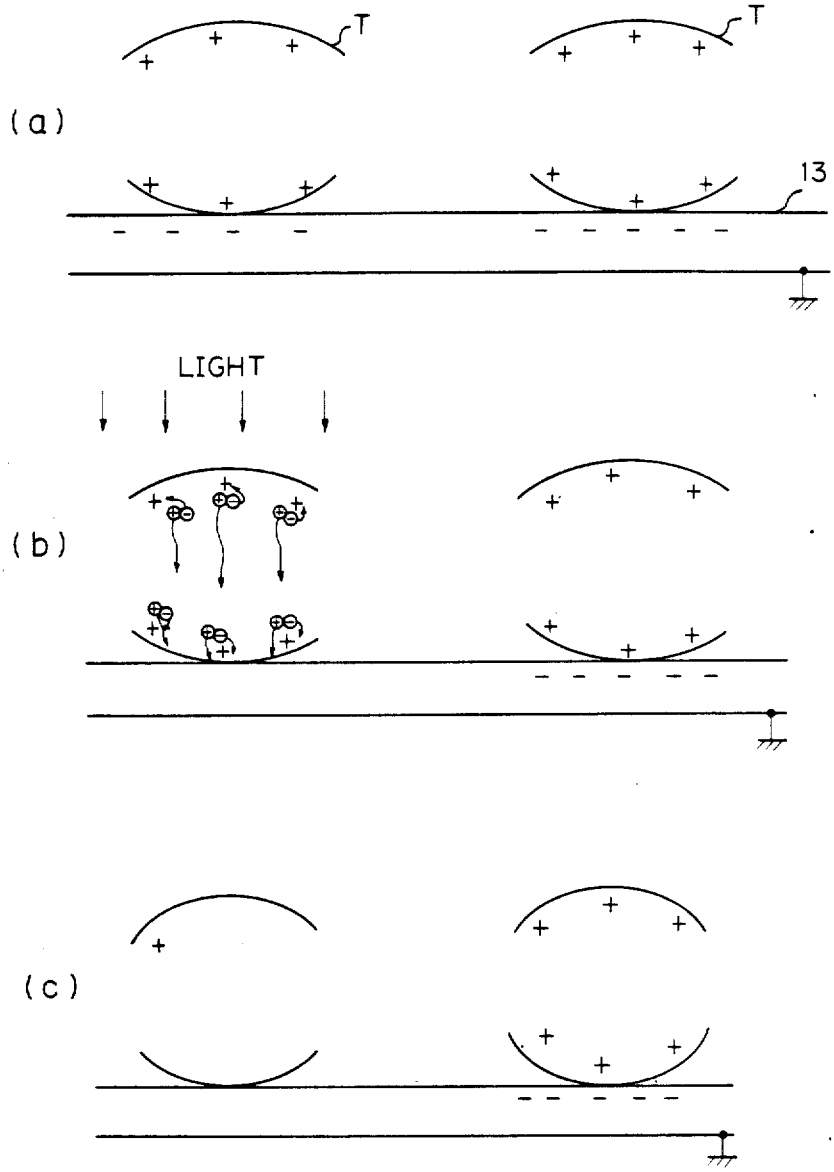
FIG. 1 is a diagram illustrating the principle of charging of the photoconductive toner of the present invention, in which (a) shows formation of a toner layer, (b) shows the state at the light exposure and (c) shows the state after the light exposure.

Referring to FIG. 1, as shown in (a), toner particules T of a toner layer formed on a substrate 13 are tribocharged with a certain polarity (particles charged with a positive polarity are described for facilitating understanding). At the light exposure step shown in (b), the toner particles T irradiated with light generate positive (+) and negative (−) photocarriers. These photocarriers are generated in the interiors of the toner particles at parts relatively close to the surfaces and since frictional charges are due to transfer of charges between the surfaces of the toner particles and the chafing material, the photocarriers and the frictional charges are in close proximity to each other. Accordingly, positive charges by tribocharging are cancelled by the negative carriers having a smaller mobility. Since the photoconductive material is a p-type semiconductor, the positive carriers have a larger mobility, and the negative charges present on the surface of the substrate are neutralized with the frictional charges possessed by the photoconductive toner. Accordingly, the positive carriers can move to the substrate. Therefore, by this combination of the binder resin and photoconductive material, charges of the exposed area are caused to disappear smoothly as shown in (c). As the result, the photosensitivity of the photoconductive toner is improved.

On the other hand, if the combination of the present invention is not adopted and the above-mentioned resin is combined with an n-type semiconductor to form a photoconductive toner, a problem arises. Namely, since photocarriers used for neutralizing frictional charges which are positive are negative carriers having a larger mobility, positive carriers having a smaller mobility are not allowed to move to the substrate but they are left as residual charges in the toner.

From the foregoing illustration, it will be readily understood that the combination of the present invention is ideal for increasing the photosensitivity.

Incidentally, by the term "photosensitivity" used in the instant specification, the speed of disappearance of charges possessed by the toner by the light exposure is meant, and in the instant specification, the photosensitivity is expressed by the half-value light exposure quantity, that is, the light exposure quantity (lux sec) necessary for halving the charge quantity.

Moreover, when it is stated that a binder resin used for the photoconductive toner of the present invention is excellent in the positive chargeability, it is meant that the resin is readily charged positively with respect to the other material to which frictional charges are given. For example, in one specific embodiment of the present invention, iron powder or ferrite powder is used for giving frictional charges to the photoconductive toner, and in this case, it is meant that the binder resin is positively charged by friction with this carrier. Accordingly, it sometimes happens that according to the tribocharging conditions, for example, the kind of the material to be chafed, one resin can be used either as the positively chargeable resin or the negatively chargeable resin. Therefore, by experiments, it is determined whether the resin is positively chargeable or negatively chargeable in each combination.

The following photoconductive substances can be used for the photoconductive toner of the present invention.

p-Type Semiconductors (Charge-Generating Substances)

Se, phthalocyanine, perylene, squalinic aic derivatives, azo pigements and indigo pigments.

n-Type Semiconductors (Charge-Generating Substances)

CdS, $TiO_2$, PbO, $SnO_2$ and ZnO.

In the case where frictional charging is effected with a magnetic material such as iron or ferrite powder, the following binder resins can be used.

Negatively Chargeable Resins

Styrene resin, acrylic resin, polyester resin, polyethylene resin, styrene-acrylic resin and epoxy resin.

Positively Chargeable Resins

Polyamide resin, polyimide resin and 2-vinylpyridine-containing copolymer resin.

In the case where a material other than the above-mentioned magnetic material is used, the chargeability characteristics of resins are experimentally confirmed and they are combined with appropriate photoconductive substances.

If the photoconductive substance is a p-type semiconductor, the photoconductive toner of the present invention is prepared by combining this semiconductor with a resin having a positive chargeability, and if the photoconductive substance is an n-type semiconductor, the photoconductive toner of the present invention is obtained by combining this semiconductor with a resin having a negative chargeability. It is preferred that 0.2 to 10 parts by weight, especially 0.3 to 5 parts by weight, of the binder resin be combined with 1 part by weight of the photoconductive substance. In order to further improve the photosensitivity, charge transport substances as described below can be used.

A hole transport substance is preferred for the p-type semiconductor, and for example, hydrazone, pyrazolone, PVK and oxadiazole can be used. For the n-type semiconductor, there can be used electron transport substances such as trinitrofluorenone, tetranitrofluorenone, tetrachanoquinodimethane and chloranil.

The charge transport substance can be used in an amount of 1.5 to 10 parts by weight, especially 3 to 5 parts by weight, per part by weight of the photoconductive substance.

Various additives can be used for improving the physical properties of the photoconductive toner. For example, there can be used flow improvers such as silica, alumina and titanium oxide, and dispersibility improves such as silicone oil. These additives are incorporated in an amount of 0.4 to 2 parts by weight per 100 parts by weight of the toner composition.

For the preparation of the toner, there can be adopted known methods, for example, a kneading and pulverizing method and a spraying method in which a solution or dispersion of the toner composition in a volatile solvent is spray-granulated. It is preferred that the granulated toner be classified according to need and a fraction having a particle size of 9 to 12 μm be collected and used.

The image-forming means using the photoconductive toner of the present invention will now be described.

When the photoconductive toner of the present invention is used in the above-mentioned known image-forming process, an image having a sufficient contrast can be obtained. However, if the photoconductive toner of the present invention is used in an improved process described below, an highly excellent image can be formed.

The first improved image-forming process comprises the following steps.

(i) Tribocharging Step

The photoconductive toner is mixed, for example, with a carrier at a certain ratio to impart a frictional charge of a certain polarity (negative polarity).

(ii) Step of Forming Layer of Photoconductive Toner

For example, a bias voltage is applied to an electroconductive substrate (positive potential is maintained on the substrate side) to form a toner layer.

(iii) Light Exposure Step

The photoconductive toner layer is subjected to imagewise light exposure.

(iv) Corona Discharge Step

Corona charging is carried out with the same polarity as that of the tribocharging to improve the transferability of the photoconductive toner.

(v) Transfer Step

The photoconductive toner corresponding to the image is electrically transferred to a recording medium such as a copying sheet by using, for example, a corona charger.

(vi) Fixing Step

The photoconductive toner transferred onto the transfer medium is fixed by using, for example, a heat roller.

In the above-mentioned process, the photoconductive toner is negatively tribocharged. If the photoconductive toner is positively tribocharged, at the step (ii) a bias voltage is applied so that a negative potential is maintained on the substrate side.

This improved image-forming process is characterized in that tribocharging is effected prior to formation of the photoconductive toner layer and corona charging is not performed prior to the light exposure step as in the conventional process but the corona charging is carried out after the light exposure step.

Our assumption on the principle of this improved image-forming process will now be described.

The photoconductive toner charged, for example, negatively at the tribocharging step is uniformly held on the substrate by application of a bias voltage, whereby a toner layer is formed. At this time, positive charges are induced on the electroconductive substrate according to the frictional charge quantity possessed by the photoconductive toner. At the subsequent imagewise light exposure step, the portion of the photoconductive toner layer corresponding to the non-image area generates negative photocarriers under the light exposure, and these negative photocarriers neutralize the frictional charges and the charges of the substrate. Accordingly, the potential of the exposed area of the photoconductive toner layer is reduced. If corona discharge is effected with the same polarity as that of the tribocharging on this photoconductive toner layer, since corona ions generated by the corona discharge have the same polarity as that of the photoconductive toner, the corona ions adhere to the toner surface preferentially from the potential-reduced portion (exposed area), and finally, the surface potential of the non-exposed area is substantially on the same level as that of the exposed area.

If a recording medium is piled on the toner layer in this state and corona discharge is effected with a reverse polarity (positive polarity), the positive charges and the negative charges of the toner layer are sucked to the transfer medium side in the state where the Coulomb force is uniform in both the exposed area and the non-exposed area. At this point, since a substantial time has not passed after the corona discharge, in the exposed area the negative charge adhere to the toner surface in the form of corona ion charges, and only the corona ions are attracted to the transfer medium. In the non-exposed area the toner per se is attracted to the recording medium because the toner per se has negative charges. Accordingly, only the toner in the non-exposed area, that is, the image area, can be effectively transferred.

In view of the foregoing, we consider that in the image-forming process using a photoconductive toner having frictional charges, if corona charging is carried out for holding corona ion charges having the same polarity as that of the frictional charges on the toner surface at the exposed area after the imagewise light exposure, the corona ion charges can be sucked to the recording medium as the dummy to prevent transfer of the toner present at the exposed area, with the result that only the toner at the non-exposed area is effectively transferred and a sharp positive image is formed. Furthermore, this process is advantageous in that removal of the toner from the exposed area (non-image area) becomes unnecessary.

In the above-mentioned improved image-forming process, several methods can be adopted as means for forming a toner layer having frictional charges on the substrate. For example, there can be adopted a method in which the photoconductive toner is mixed with a carrier to form a two-component type developer and a known two-component type magnetic brush is formed on an electroconductive sleeve, and a method in which only the toner having frictional charges is held on a fur brush. In these methods, if a bias voltage is applied between a substrate composed of a metallic material such as Al or an electroconductive substrate obtained by rendering the surface of a resin material electroconductive and the above-mentioned sleeve or fur brush, a toner layer can be easily formed.

At the corona charging step conducted after the imagewise light exposure, corona discharge is carried out to such an extent that the potential of the surface of the toner layer at the exposed area is substantially equal to the surface potential of the non-exposed area, whereby the intended effect of the present invention can be sufficiently attained. The voltage applied at the corona charging step is appropriately determined according to the capacity of the corona charger used and the tribochargeability of the photoconductive toner.

For obtaining not only a positive image but also a negative image, there can be adopted the following second improved image-forming process, which comprises the following steps.

(i) Tribocharging Step

The photoconductive toner is mixed with, for example, a carrier at a certain ratio to impart a frictional charge of a certain polarity (for example, negative polarity) to the toner.

(ii) Step of Forming Layer of Photoconductive Toner

A bias voltage is applied onto an electroconductive substrate (positive potential is maintained on the substrate side) to form a toner layer.

(iii) Step of Imagewise Light Exposure and Simultaneous Charging

The photoconductive toner layer is subjected to the imagewise light exposure and simultaneously, the main charging (corona discharge) is carried out with a polarity reverse to the charge polarity of the toner.

(iv) Transfer Step

The photoconductive toner corresponding to the image is electrically transferred onto a recording medium such as a copying sheet by using, for example, a corona charger.

(v) Fixing Step

The photoconductive toner on the transfer medium by using, for example, a heat roller.

Also in this process, if the photoconductive toner is positively tribocharged, at the step (ii) a bias voltage is supplied so that a negative potential is maintained on the substrate side.

This improved image-forming process is clearly distinguishable over the conventional process in that when the photoconductive toner layer is formed on the electroconductive substrate, the toner is tribocharged in advance to impart a charge of a certain polarity to the interior of the toner and the light exposure is carried out simultaneously with the main charging conducted with a polarity reverse to the charge polarity of the photoconductive toner.

By this tribocharging, that is, preliminary charging, and the imagewise light exposure conducted simultaneously with the main charging, the electrostatic latent image formed at the exposed area is sufficiently distinguished from the electrostatic latent image formed at the non-exposed area with respect to the potential, and therefore, a sharp image excellent in the contrast can be obtained.

Our assumption on the principle of the second improved image-forming process is as follows.

Generally, at the corona charging conducted after formation of the toner layer, it is difficult to impart a charge to the interior, and it is considered that only the surface portion of the toner is practically charged. Namely, it is considered that charges given by the corona charging area corona ions adhering to the outer side of the surface of the toner. Accordingly, if uniform corona charging is applied after formation of a toner layer according to the conventional process, even when positive and negative photocarriers are formed in the interior of the toner by the light exposure at the imagewise light exposure step, one photocarrier merely forms a pair with the surface charge as the opposite charge and hence, charges in the vicinity of the surface merely move to the interior of the toner. Accordingly, the charges possessed by the toner per se are not substantially charged by the light exposure.

Therefore, the electrostatic latent image formed on the toner layer by the light exposure has not a sufficient charge distribution and no contrast can be obtained. When the toner layer is then transferred to a copy sheet, even if corona discharge is carried out with a polarity reverse to that of the above-mentioned corona charging, the corona ions on the surface of the toner move toward the copy sheet, and the toner having a small amount of charges held in the interior is hardly transferred. Therefore, it is considered that a sharp image can hardly be formed.

In contrast, according to the above-mentioned improved process, at the light-exposed area, photocarriers are generated by the light exposure to increase the electroconductivity of the toner, and by the main charging conducted simultaneously with the light exposure, charges having a polarity reverse to that of the main charging, which have been given to the interior of the toner by the frictional charging, are neutralized and charges of the main charging can be given even to the interior of the toner. In the non-exposed area, since photocarriers are not formed and electric insulation is kept, corona ions adhere to the surface of the toner in the state where the toner retains charges by the frictional charging in the interior thereof and the toner surface comes to have charges of the main charging having a polarity reverse to the polarity of the interior charges.

Accordingly, there is brought about a great difference of the charges possessed by the toner between the exposed area and the non-exposed area.

Therefore, if the transfer is carried out with the same polarity as the polarity of the main charging, only the toner present at the non-exposed area, which has charges of the reverse polarity in the interior, is transferred to the copy sheet to form a sharp positive image on the copy sheet. In the case where the transfer is carried out with a polarity reverse to the polarity of the main charging, in the non-exposed area, since the toner has in the interior thereof the frictional charges of the same polarity, only the charges present on the toner surface are transferred. On the other hand, in the exposed area, since the toner per se has the charges of the reverse polarity, the toner per se is transferred. Accordingly, in this case, only the toner present at the exposed area is transferred to a copying sheet, and an image negative to the exposed image is obtained in a sharp state.

The present invention will now be described in detail with reference to the following examples that by no means limit the scope of the invention.

EXAMPLE 1

A photoconductive toner material was prepared by dispersing 1 part by weight of copper phthalocyanine as a p-type photoconductive substance and 3 parts by weight of a polyamide type resin (Polymid S40-E supplied by Sanyo Kasei) as a positively chargeable resin in 80 parts by weight of a methanol/toluene (1/1) mixed solvent. A photoconductive toner having an average particle size of 10 μm was prepared from the resulting dispersion by spray drying. The photoconductive toner was mixed with a ferrite carrier to effect positive charging, and the mixture was charged in a magnetic brush developing device for an electrophotographic copying machine and the photoconductive toner was uniformly applied onto an aluminum substrate by using this developing device.

The photoconductive layer was irradiated with light at 800 luxes and the sensitivity was measured. The half-value light exposure quantity expressed by the light quantity necessary for having the initial surface potential was 240 lux·sec.

The photoconductive toner similarly applied uniformly onto the aluminum substrate was subjected to corona charging, imagewise light exposure and removal of the toner from the non-image area, and a transfer sheet was piled on the toner layer and corona discharge of a negative polarity was carried out from the back surface to effect the transfer of the toner. A sharp blue copied image excellent in the contrast was obtained. The image density was a 0.9 and the fog density was 0.05.

EXAMPLE 2

In the same manner as described in Example 1, a photoconductive toner material was prepared by dispersing 3 parts by weight of photoconductive ZnO as an n-type photoconductive substance and 1 part by weight of a polystyrene type resin (Piccolastic D-150 supplied by Hercules) as a negatively chargeable resin in 60 parts by weight of toluene as a solvent. A white photoconductive toner having an average particle size of 10 μm was prepared from this dispersion by spray drying. The photoconductive toner was mixed with a ferrite carrier to effect negative charging. The photoconductive toner was charged in a magnetic brush developing device for an electrophotographic copying machine and the photoconductive toner was uniformly applied to an aluminum substrate by using this developing device.

The photoconductive toner layer was irradiated with light at 800 luxes, and the sensitivity was measured. The half-value light exposure quantity expressed by the light quantity necessary for halving the initial surface potential was 240 lux·sec.

The photoconductive toner similarly applied uniformly onto the aluminum substrate was subjected to corona charging, imagewise light exposure and removal of the toner from the non-image area. Then, a black transfer sheet was piled on the toner layer and corona discharge of a positive polarity was carried out from the back surface to effect the transfer of the photoconductive toner. A sharp white copied image excellent in the contrast was obtained as in Example 1. The image density was 1.2 and the fog density was 0.02.

EXAMPLE 3

A toner was prepared by adding 3 parts by weight of a hydrazone derivative to the toner composition of Example 1, and the experiment was carried out in the same manner as described in Example 1. It was found that the half-value light exposure quantity was 150 lux·sec, the image density was 1.1 and the fog density was 0.01.

EXAMPLE 4

A toner was prepared by adding 0.01 part by weight of Rose Bengale to the toner composition of Example 2, and the experiment was carried out in the same manner as in Example 1. It was found that the half-value light exposure quantity was 100 lux·sec, the image density was 0.8 and the fog density was 0.01.

EXAMPLE 5

A negatively chargeable toner composition was prepared by dispersing 3 parts by weight of photoconductive ZnO as an n-type photoconductive substance, 1 part by weight of a polystyrene type resin (Piccolastic D-150 supplied by Hercules) as a negatively chargeable resin and 0.03 part by weight of Spilon Black as a colorant in 60 parts by weight of toluene (containing Rose Bengale as a sensitizer) as a solvent. A reddish violet photoconductive toner having an average particle size of 10 μm was prepared from the dispersion by spray drying.

By using the so-prepared toner, an image was formed according to the above-mentioned first improved image-forming process.

Tribocharging Step

The photoconductive toner was mixed with a carrier at a weight ratio of 1/10, and the mixture was stirred to tribocharge the toner negatively.

Step of Forming Photoconductive Toner Layer

The two-component type developer was charged in a known developing device for a two-component type developer, and the photoconductive toner was applied to a substrate by the magnetic brush method to form a toner layer. For formation of the toner layer, a bias voltage was applied between an electroconductive sleeve and an electroconductive substrate composed of aluminum, which was earthed, so that the potential on the sleeve side was −500 V. Under these conditions, less than about 10 layers were formed as the toner layer.

Light Exposure Step

The imagewise light exposure was carried out according to the ordinary slit type light exposure method.

Corona Discharge Step

The toner layer was negatively charged by a corona charger to which a potential of −6 KV was applied. The toner layer had a substantially uniform surface potential of about −300 V.

Transfer Step

According to the known procedures, a transfer sheet as the recording medium was piled on the toner layer, and a voltage of +6 KV was applied from the back of the transfer sheet to effect the transfer of the toner.

Fixing Step

The recording sheet was heat-fixed by a heat roller having a surface temperature of 200° C.

The obtained copy had an image faithful to the original image.

For comparison, an electrostatic latent image of a toner layer formed in the same manner as described above except that the negative corona charging step was not carried out was transferred by corona discharge. Only a copied image having a large fog was obtained.

The data of the copied images obtained by the above-mentioned two image-forming processes are shown in Table 1.

TABLE 1

| | Image Density | Fog Density |
|---|---|---|
| Present Invention | 0.9 | 0.01 |
| Comparison | 0.6 | 0.1 |

Separately, a toner layer was formed on the electroconductive substrate by using a photoconductive toner (having the same composition as described above) which had not been sufficiently tribocharged, and the toner layer was negatively charged by a corona discharger to which a voltage of −6 KV was applied. Then, the imagewise light exposure was carried out and a voltage of +6 KV was applied to the corona discharger to effect the transfer. The transferred image was fixed to obtain a copied image. Though the copied image had no fog, the contrast was low. The image density wsa 0.7.

From the foregoing experimental results, it is seen that if after the tribocharging step and imagewise light exposure step, the corona charging was carried out with the same polarity according to the image-forming process of the present invention, a sharp image excellent in the contrast can be obtained.

EXAMPLE 6

Figure 2:
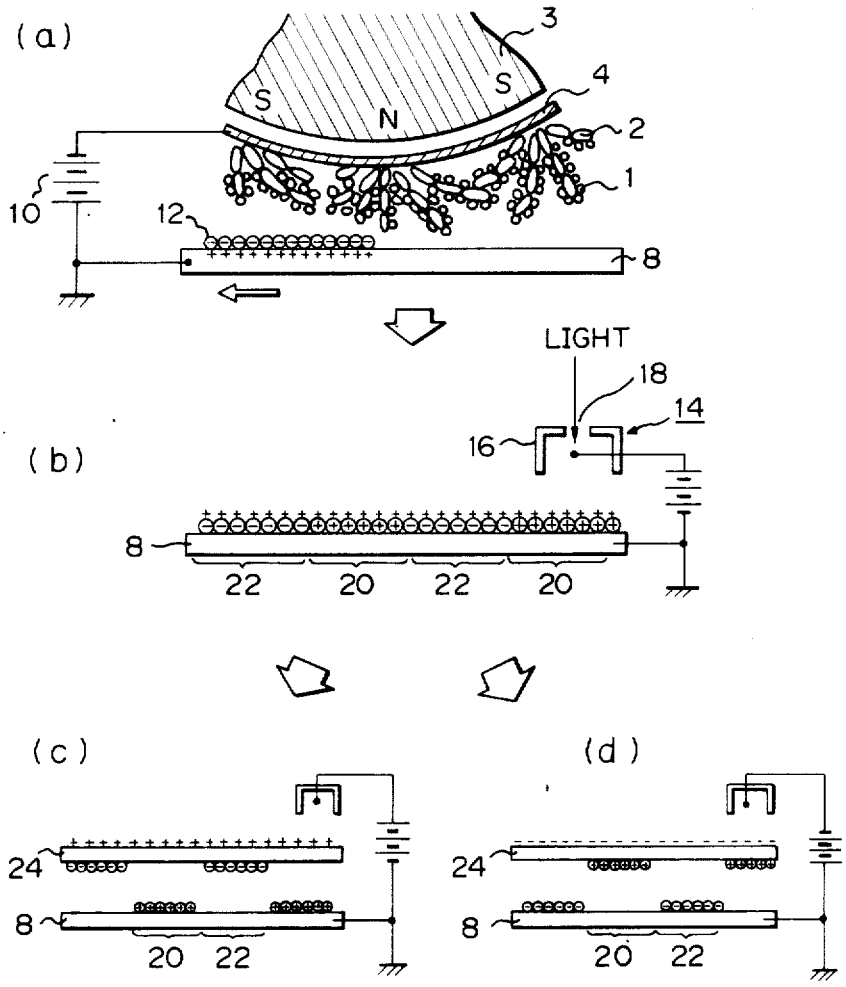
FIG. 2 is a diagram illustrating an example of the image-forming process using the photoconductive layer of the present invention, in which (a) shows the step of forming a toner layer, (b) shows the step of main charging and simultaneous imagewise light exposure and (c) and (d) show the step of transfer.

By using the reddish violet photoconductive toner obtained in Example 5, an image was formed according to the above-mentioned second improved image forming process shown in FIG. 2.

Tribocharging Step

The photoconductive toner 1 was mixed with a magnetic carrier 2 at a weight ratio of 7/93, and the mixture was stirred to impart sufficient frictional charges to the photoconductive toner. The two-component type developer comprising the toner and the carrier was supplied onto an electroconductive non-magnetic sleeve 4 having a magnetic roll 3 installed therein to form a magnetic brush. At this point, the photoconductive toner 1 had in the interior thereof negative charges generated by the frictional charging.

Step of Forming Photoconductive Toner Layer

A bias voltage was applied between an electroconductive substrate 8 composed of aluminum, which was earthed, and the sleeve 4 from a power source 10 so that the voltage on the sleeve side was −500 V, whereby a uniform layer 12 of the photoconductive toner 1 was formed on the substrate 8. According to this process, less than about 10 layers were formed as the toner layer on the substrate, as shown in FIG. 2(*a*).

Step of Imagewise Light Exposure and Simultaneous Charging

The toner layer 12 was positively charged by a corona charger 14 to which a direct current voltage of +6 KV was applied. Simultaneously with this positive charging (main charging), the imagewise light exposure was carried out by an imagewise light exposure window 18 which was disposed on the side, opposite to the toner layer side, of a shield case 16 of the corona charger 14.

By this main charging and simultaneous imagewise light exposure, the toner layer at an exposed area 20 wsa positively charged and the toner layer at a non-exposed area 22 had negative charges in the interior thereof and positive corona ions on the surface thereof, as shown in FIG. 2(*b*).

Transfer Step

A copy sheet 24 was piled on the toner layer having an electrostatic latent image thus formed thereon, and the transfer of the toner layer was carried out by applying a voltage to the back surface of the copy sheet by the corona charger to which a voltage of +5 KV was applied. The toner at the non-exposed area was transferred to form a positive image as shown in FIG. 2(*c*). When the corona transfer was carried out while applying a voltage of −6 KV, the toner at the exposed area was transferred to form a negative image as shown in FIG. 2(*d*).

Fixing Step

The fixing operation was carried out in the same manner as described in Example 5.

Thus, a sharp positive or negative image excellent in the contrast was obtained by controlling the polarity of the voltage applied to the transfer corona charger.

The obtained results are shown in Table 2.

TABLE 2

| | Image Density | Fog Density |
|---|---|---|
| Negative Image | 0.9 | 0.02 |
| Positive Image | 1.0 | 0.01 |

We claim:

1. A photoconductive toner having a particle size of 9 to 12 μm, which comprises (i) a photoconductive substance, (ii) 0.2 to 10 parts by weight, per part by weight of said photoconductive substance, of a binder resin medium and (iii) 1.5 to 10 parts by weight, per part by weight of said photoconductive substance, of a charge transport substance, said photoconductive substance and said charge transport substance being dissolved or dispersed in said binder resin medium, wherein said photoconductive substance is at least one p-type semiconductor selected from the group consisting of Se, phthalocyanine, perylene, squalinic acid derivatives, azo pigments and indigo pigments, said binder resin medium has a positive tribochargeability such that when said binder resin medium is tribocharged by at least one tribocharging member selected from the group consisting of iron and ferrite powders, said binder resin medium is positively charged, said binder resin medium is at least one resin selected from the group consisting of polyamide resins, polyimide resins and 1-vinylpyridine-containing copolymer resins, and said charge transport substance is at least one hole transport substance selected from the group consisting of hydrazone, pyrazolone, polyvinylcarbazole and oxadiazole.

2. A photoconductive toner having a particle size of 9 to 12 μm, which comprises (i) a photoconductive substance, (ii) 0.2 to 10 parts by weight, per part by weight of said photoconductive substance, of a binder resin medium and (iii) 1.5 to 10 parts by weight, per part by weight of said photoconductive substance, of a charge transport substance, said photoconductive substance and said charge transport substance being dissolved or dispersed in said binder resin medium, wherein said photoconductive substance is at least one n-type semiconductor selected from the group consisting of CdS, $TiO_2$, PbO, $SnO_2$ and ZnO, said binder resin medium has a negative tribochargeability such that when said binder resin medium is tribocharged by at least one tribocharging member selected from the group consisting of iron and ferrite powders, said binder resin medium is negatively charged, said binder resin medium is at least one resin selected from the group consisting of styrene type resins, acrylic resins, polyester resins, polyethylene resins, styrene-acrylic copolymer resins and epoxy resins, and said charge transport substance is at least one electron transport substance selected from the group consisting of trinitrofluorenone, tetranitrofluorenone, tetracyanoquinodimethane and chloranil.

* * * * *

UNITED STATES PATENT AND TRADEMARK OFFICE

CERTIFICATE OF CORRECTION

PATENT NO. : 4,701,389

DATED : October 20, 1987

INVENTOR(S) : TERUYO MORIMOTO, ET AL.

It is certified that error appears in the above-identified patent and that said Letters Patent is hereby corrected as shown below:

IN THE CLAIMS

Column 12, line 10, claim 1, "1-vinylpyridine" should be --2-vinylpyridine--.

Signed and Sealed this

Fourteenth Day of June, 1988

*Attest:*

*Attesting Officer*

DONALD J. QUIGG

*Commissioner of Patents and Trademarks*